US008727559B2

(12) United States Patent
Boyer

(10) Patent No.: US 8,727,559 B2
(45) Date of Patent: May 20, 2014

(54) COMPACT BEAUTY STATION

(76) Inventor: Daniel Boyer, Mont-Tremblant (CA)

( * ) Notice: Subject to any disclaimer, the term of this patent is extended or adjusted under 35 U.S.C. 154(b) by 292 days.

(21) Appl. No.: 13/423,230

(22) Filed: Mar. 18, 2012

(65) Prior Publication Data

US 2012/0242204 A1 Sep. 27, 2012

(30) Foreign Application Priority Data

Mar. 23, 2011 (GB) ..... 1104895.6

(51) Int. Cl.
*A47B 67/04* (2006.01)
*A47B 67/00* (2006.01)

(52) U.S. Cl.
USPC ..... 362/135; 362/137; 362/141; 312/227

(58) Field of Classification Search
CPC ..... A45D 33/006; A45D 33/008; A45D 33/02–33/16
USPC ..... 362/135–144; 312/224–227
See application file for complete search history.

(56) References Cited

U.S. PATENT DOCUMENTS

| | | | | |
|---|---|---|---|---|
| 159,501 A | | 2/1875 | Cogswell | |
| 560,266 A | | 5/1896 | Herrick | |
| 1,651,898 A | | 12/1927 | Maillard | |
| 2,145,462 A | | 1/1939 | Speck | |
| 2,582,593 A | * | 1/1952 | Kramer | 132/293 |
| 2,783,764 A | * | 3/1957 | Loy | 132/304 |
| 3,059,103 A | | 10/1962 | Myerberg | |
| 3,684,344 A | | 8/1972 | Gilinger | |
| 3,858,592 A | | 1/1975 | Rickenbaker | |
| D293,403 S | | 12/1987 | Umanoff et al. | |
| 4,752,863 A | | 6/1988 | Parrott | |
| D304,274 S | | 10/1989 | Baus | |
| 7,152,991 B2 | | 12/2006 | Jines et al. | |
| 2006/0006772 A1 | | 1/2006 | Galindo et al. | |

FOREIGN PATENT DOCUMENTS

| | | |
|---|---|---|
| FR | 1219941 | 12/1959 |
| FR | 2709403 | 9/1993 |

* cited by examiner

*Primary Examiner* — Karabi Guharay
*Assistant Examiner* — Nathaniel Lee

(57) ABSTRACT

A beauty station formed as a cabinet adapted to be hung on a wall, the cabinet comprising a main structural frame generally shaped as a box having side walls, a top wall, a bottom wall, a back wall, and a front wall defining an interior space. The front wall being formed as a flip down lid member pivotally connected at one edge to the bottom wall to thereby open and close the interior space. A mobile section adapted to move upwards and outwards from the interior space when the lid member is pivoted to open the interior space, and including a mirror, and at least one light source.

10 Claims, 9 Drawing Sheets

COMPACT BEAUTY STATION

This application claims priority based on request GB104895.6 filed Mar. 23, 2011

FIELD OF THE INVENTION

The present invention relates generally to furniture but more particularly to a wall hung cabinet for personal care such as hair and makeup.

BACKGROUND OF THE INVENTION

There are many types of pieces of furniture used for hair and makeup. There are also portable, compact makeup kits that open up to reveal a mirror, lights and makeup storage sections.

Whereas furniture takes up a lot of space and may not be practical in a house or an apartment with small bedrooms, they have the advantage of having large mirrors and plenty of space for storing beauty supplies. On the other hand, compact makeup cases are unobtrusive, easy to carry but have either a small mirror, or no mirror at all. They also have limited storage capacity, and you still need a table to use them.

SUMMARY OF THE INVENTION

In view of the foregoing disadvantages inherent in the known devices now present in the prior art, the present invention, which will be described subsequently in greater detail, is to provide objects and advantages which are:

To provide for an unobtrusive yet large enough hair and makeup station sometimes referred to as "beauty station".

In order to do so, the invention consists in a beauty station formed as a cabinet adapted to be hung on a wall, the cabinet comprising a main structural frame generally shaped as a box having side walls, a top wall, a bottom wall, a back wall, and a front wall defining an interior space.

The front wall being formed as a flip down lid member pivotally connected at one edge to the bottom wall to thereby open and close the interior space. A mobile section adapted to move upwards and outwards from the interior space when the lid member is pivoted to open the interior space, and including a mirror, and at least one light source.

At least one cable and pulley apparatus connected between the mobile section, the main frame, and the lid member, such that when the lid member is pivoted to open the interior space the mobile section moves upwards and outwards from the interior space, and when the lid member is pivoted to close the interior space the mobile section moves downwards and inwards into the interior space.

An electrical system adapted to deliver electricity to the at least one light source. A switch member connected to the electrical system and the main frame, and adapted to allow electric current to flow to the at least one light source when the lid member is pivoted to open the interior space, and cut off electric current to the at least one light source when the lid member is pivoted to close the interior space.

In one embodiment, the main structural frame includes interior side walls respectively parallel to the side walls and forming interior side portions that are each adapted to house a cable and pulley apparatus, and wherein the side walls each include one sliding track adapted to hold and guide a respective sliding pulley of each the at least one cable and pulley apparatus, such that when the lid member is pivoted each the sliding pulley slides along its respective sliding track.

In another embodiment, a pair of spaced pivotal holding brackets are connected between the lid member and the main frame; the pair of spaced pivotal holding brackets each include a holding member and a pivoting member; each the holding member is formed having an L-shape and has a respective the sliding pulley of each the cable and pulley apparatus attached at an end section thereof, such that when the lid member is pivoted to open or close the interior space each the sliding pulley and respective holding member slide along its respective sliding track; and the pivoting members each being pivotally attached to the opposite end section of each respective holding member and securely attached to the lid member, such that the pivoting members are adapted to pivot with the lid member, pivot with respect to each respective holding member, and wherein one the pivoting member contacts the switch member when the lid member is in a fully opened position such that the electric current is allowed to flow to the at least one light source, and at least one outlet and disengage from the switch member when the lid member is retracted from its fully opened position such that the electric current is cut off from the at least one light source and at least one outlet.

In yet another embodiment, the cable of each of the cable and pulley apparatus is attached at one end to a respective adjustment member of the mobile section, placed upon a plurality of respective pulleys of the cable and pulley apparatus, and attached at their respective opposite ends to respective distal ends of the end portions of the spaced pivotal holding brackets.

In still another embodiment, each of the adjustment member of the mobile section includes a screw member that is adapted to increase or decrease the length of available cable when turned.

In a further embodiment, the interior side portions of the main structural frame further include a retaining part on each side of the mobile section so as to facilitate the vertical linear movement within a guiding track located on the main frame so as to hold both the main frame and the mobile section in place whether the cabinet is fully opened or closed, and wherein the interior side portions include enough space to house side portions of the moving section when in a closed position.

In yet another embodiment, the at least one light source comprises a plurality of light bulbs connected on each side of the mobile section, and wherein the plurality of light bulbs connected on each side of the mobile section are adapted to be stored within the interior side portions of the main structural frame when the lid member is pivoted to close the interior space.

In still another embodiment, the interior space further includes a plurality of shelves and compartments, such that when the mobile section is moved upwards and outwards from the interior space, the shelves and compartments are exposed and usable.

In yet another embodiment, the main frame includes at least one night light connected to the electrical system and adapted to be turned on when the beauty station is hung on a wall and is not being used.

In still another embodiment, an additional wire and outlet connected to the electrical system and adapted to offer an electrical connection for additional electrical items.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
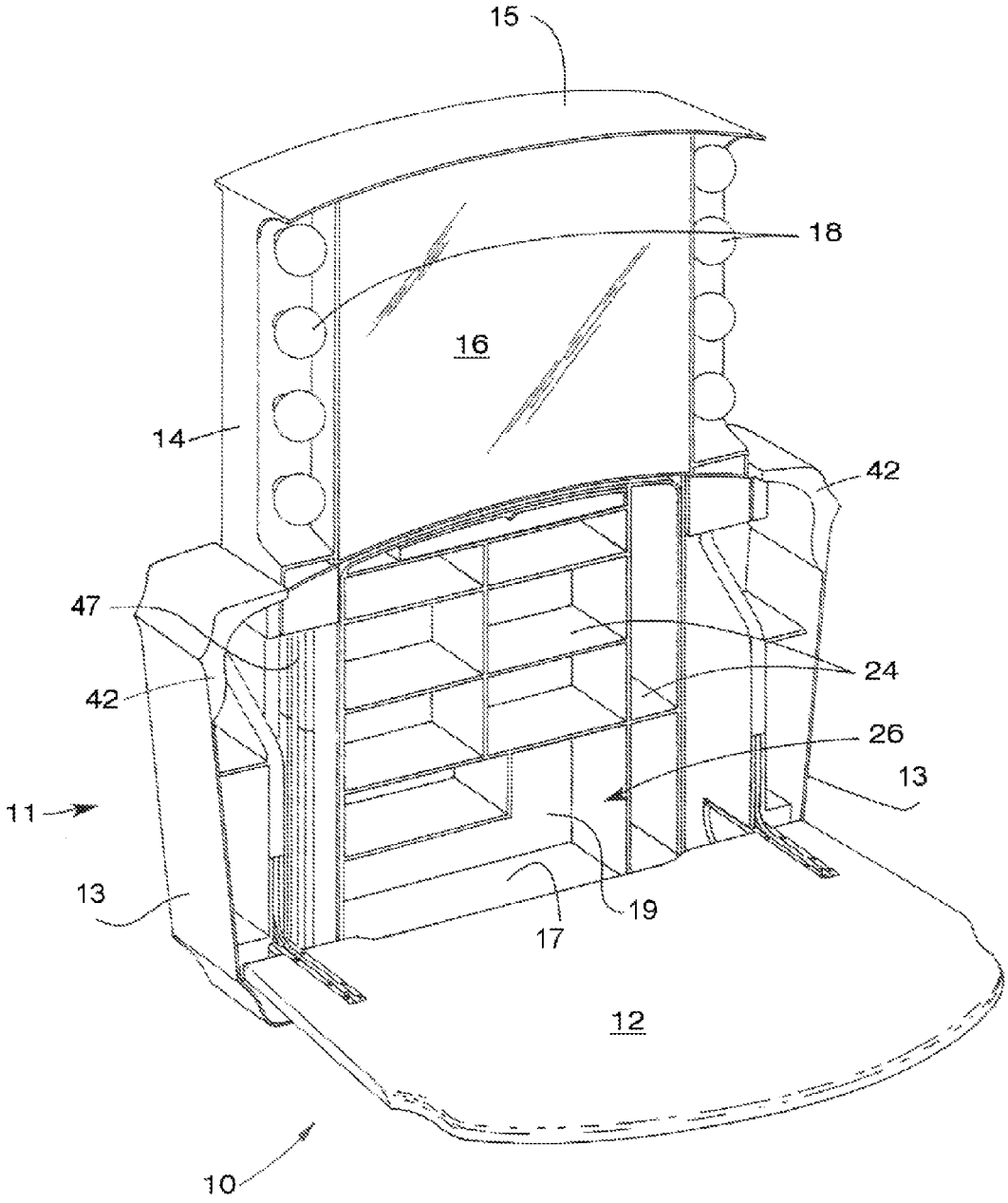
FIG. 1 Isometric view of the invention with lid lowered and mirror raised.
Figure 2:
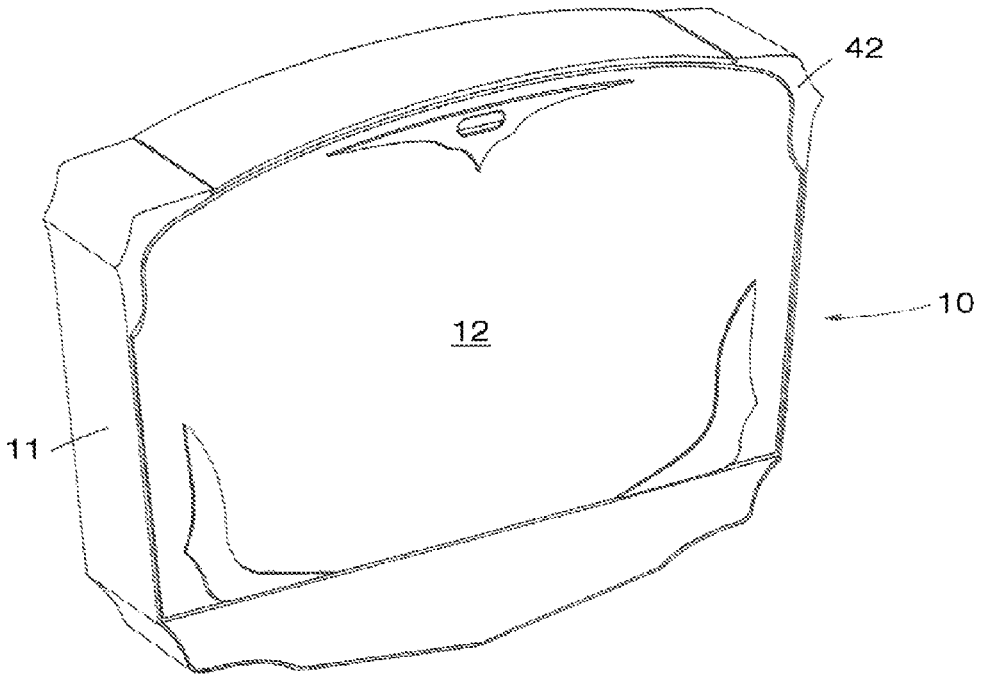
FIG. 2 Isometric view of the invention with raised lid.
Figure 3:
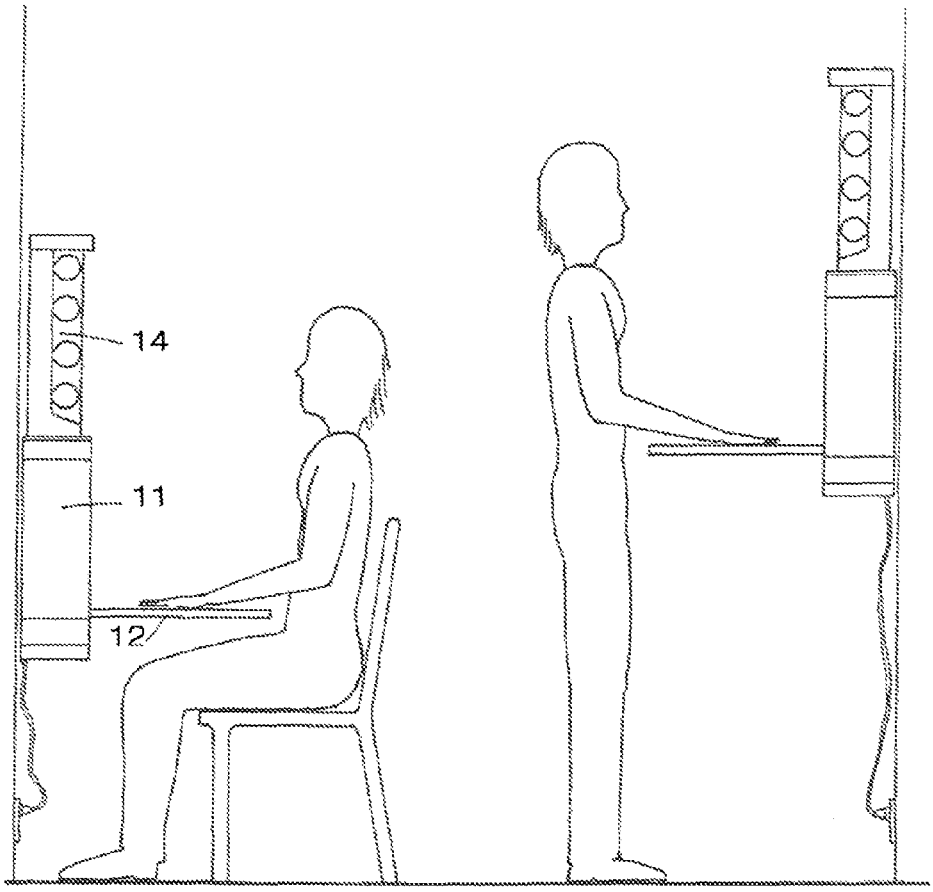
FIG. 3 Side elevation showing two configurations possible of the invention.
Figure 4:
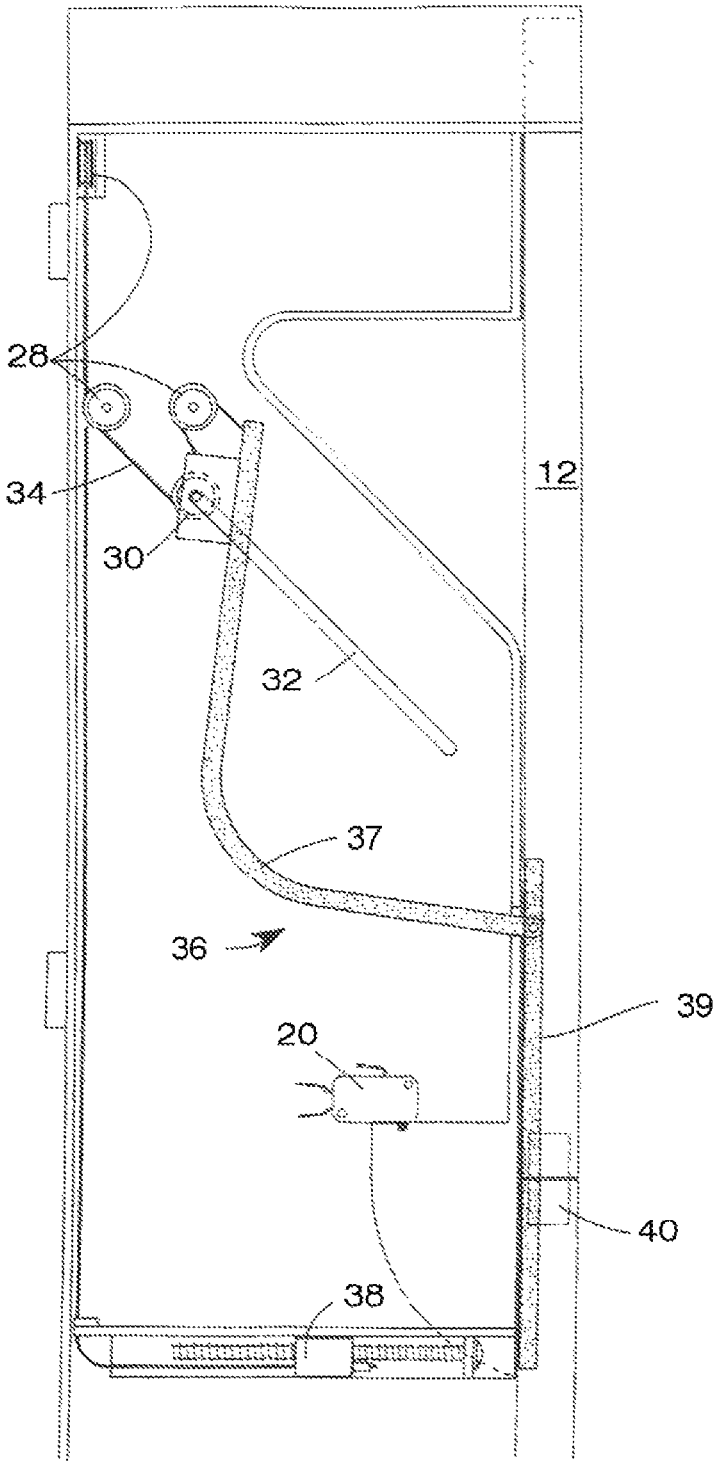
FIG. 4 Cutaway side view with lid raised.
Figure 5:
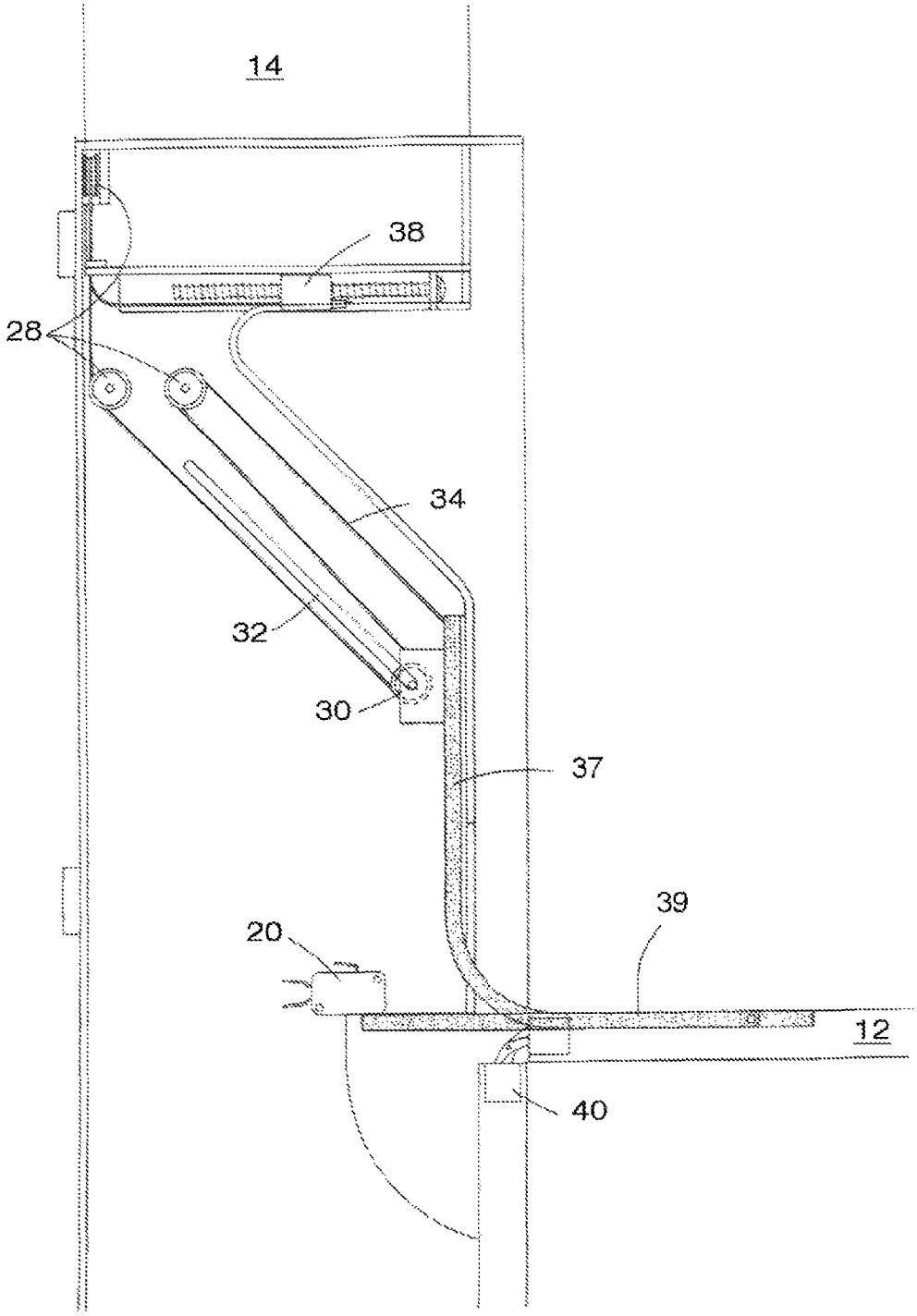
FIG. 5 Cutaway side view with lid lowered.
Figure 6:
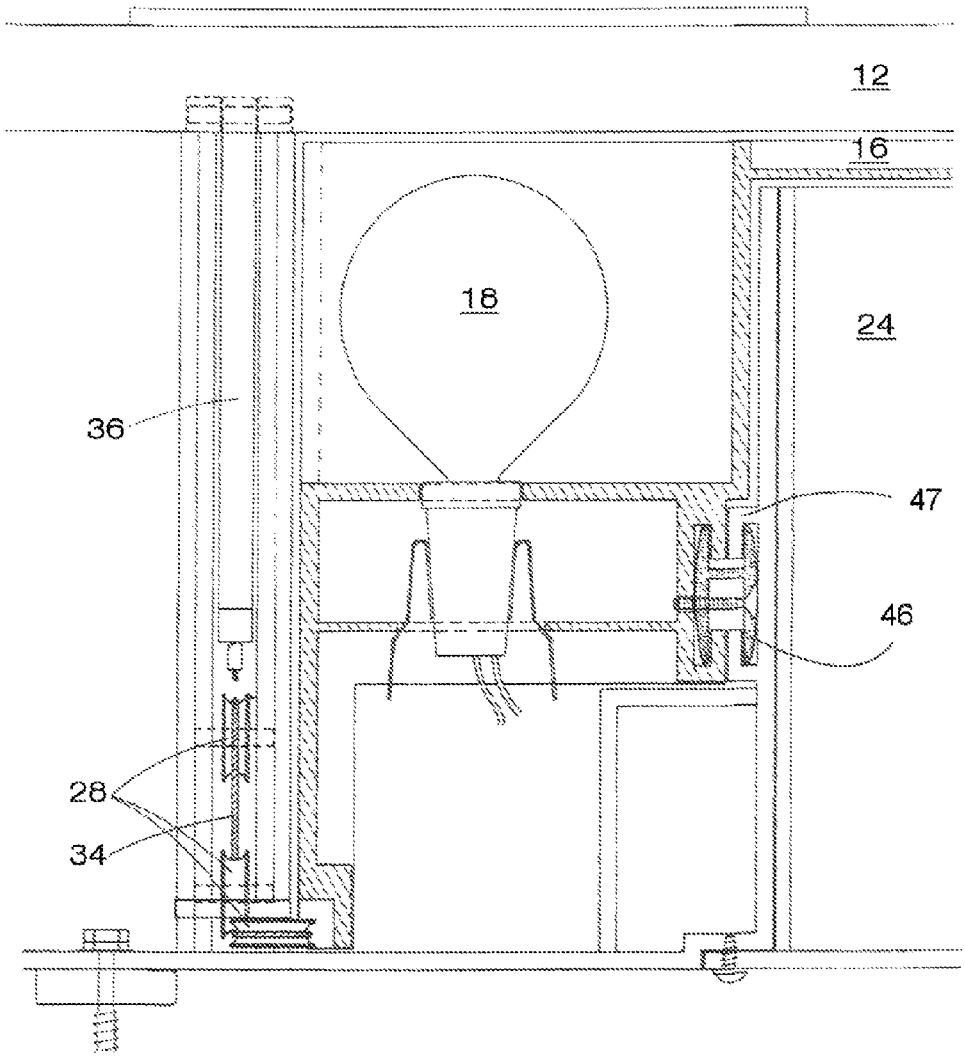
FIG. 6 Cutaway top view of the pulley mechanism.
Figure 7:
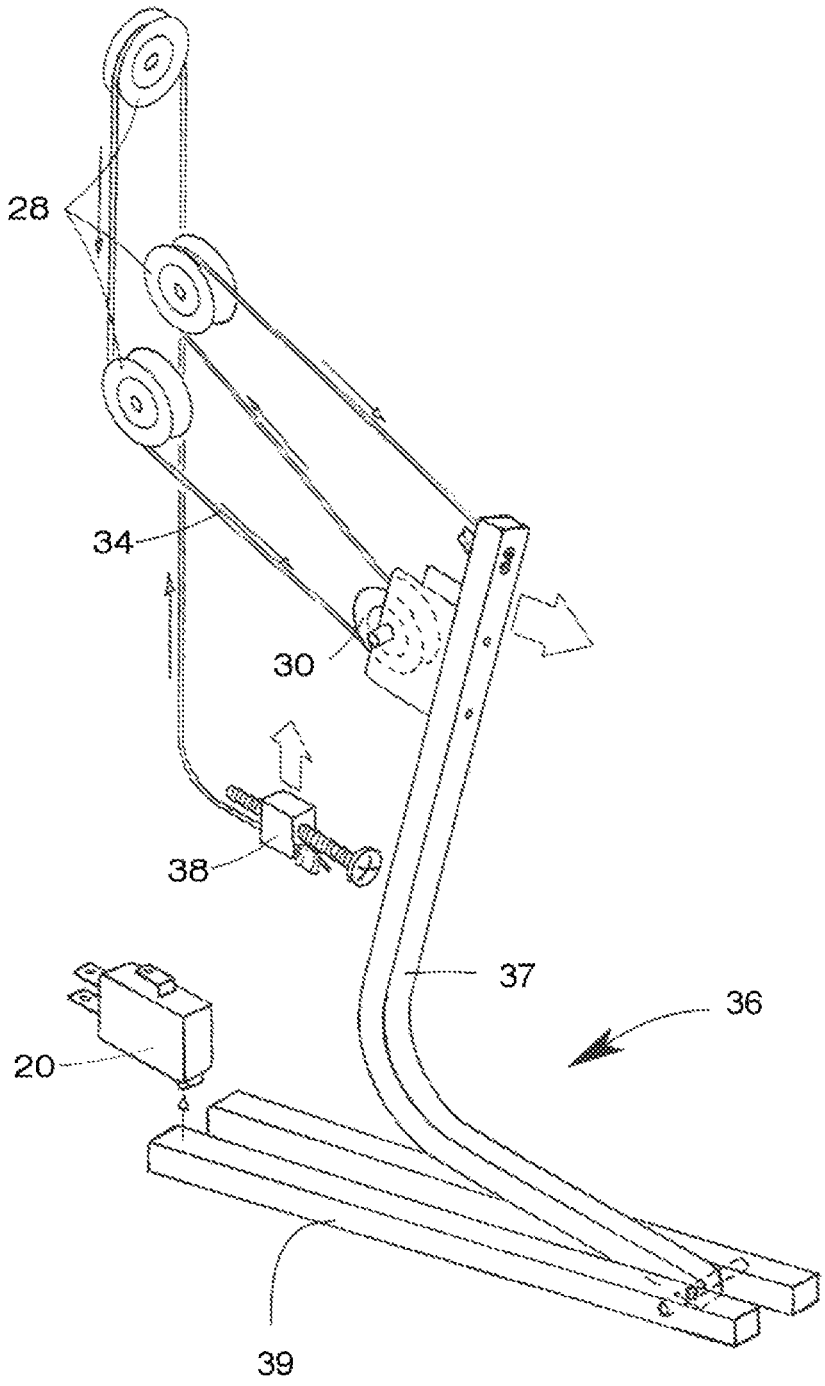
FIG. 7 Isometric view of the pulley mechanism.
Figure 8:
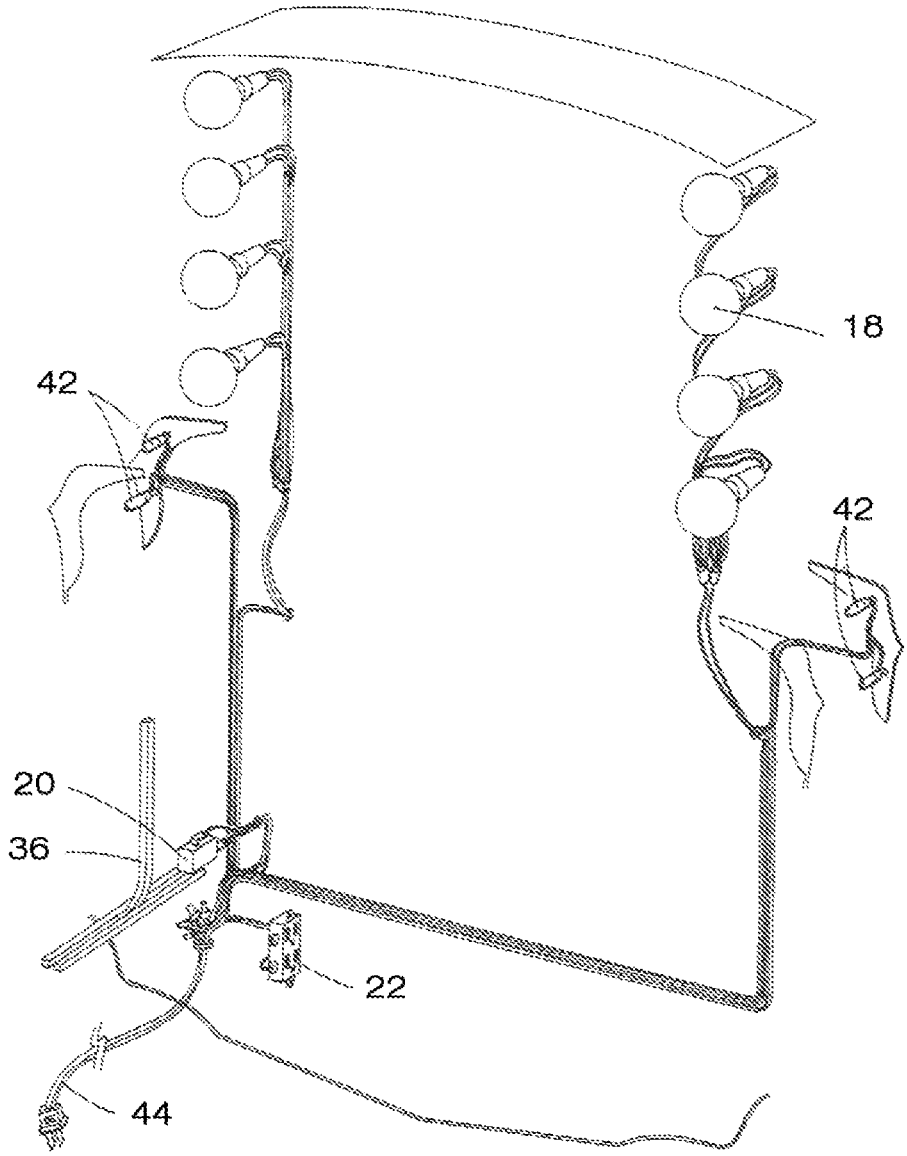
FIG. 8 Isometric view of the electrical circuit.
Figure 9:
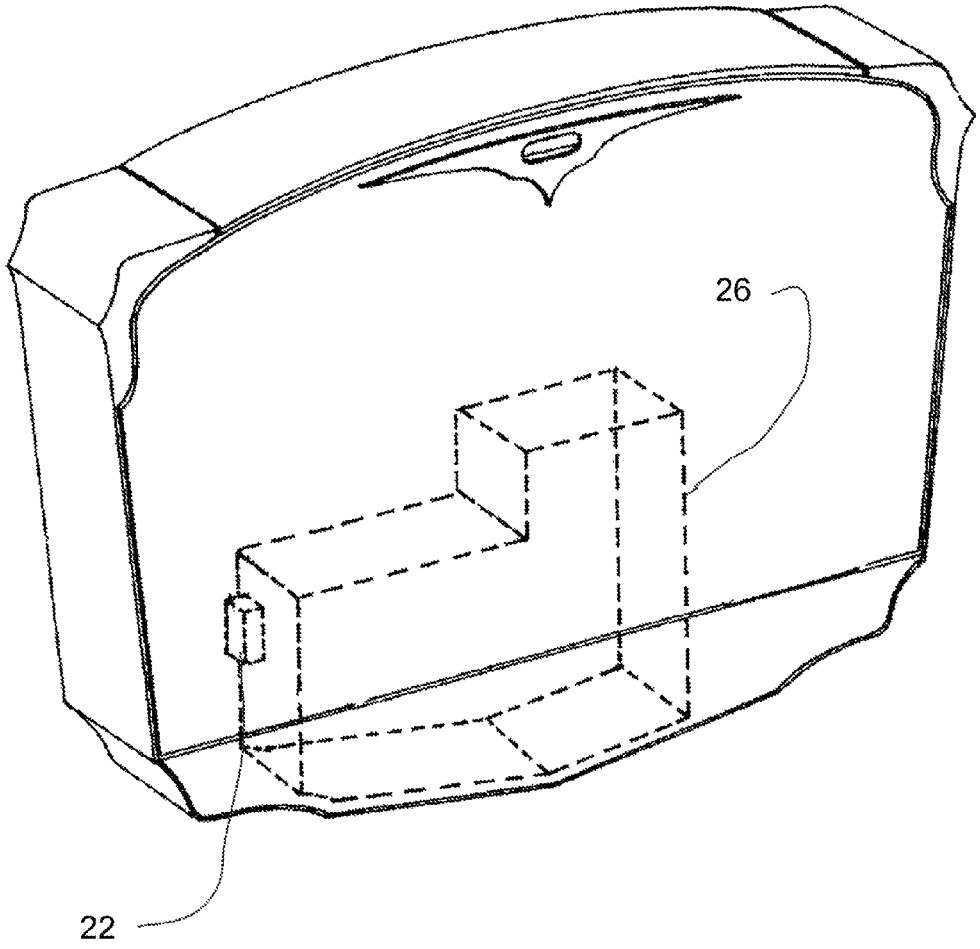
FIG. 9 Isometric view showing a large compartment.

A wall hung cabinet (10) has a main structural frame (11), and a flip down lid member (12). The cabinet (10) is generally comprised of the main frame (11) generally shaped as a box having side walls (13), a top wall (15), a bottom wall (17), a back wall (19), and a front wall—which is in fact the flip down lid member (12)—defining an interior space. The cabinet (10) also includes a mobile section (14) comprised of a mirror (16) and a plurality of side lights (18), as is known in professional makeup stations.

Lowering the lid (12) automatically causes four actions:

a) The mobile section (14) is raised at the user's face level.

b) A switch (20) turns on the side lights (18) and brings electrical current to a power outlet (22).

c) A plurality of shelves (24) and a large compartment (26) are made accessible.

d) The lid (12) is horizontal and acts a countertop surface.

A retaining part (46) on each side of the mobile section (14) facilitates the vertical linear movement within a guiding track (47) located on the main frame (11) so as to hold both the main frame (11) and the mobile section (14) in place whether the cabinet (10) is fully opened or closed.

Raising the lid (12) automatically causes the opposite effects as it does when lowering. On each side of the cabinet (10) is a pulley apparatus (28), a sliding pulley (30) sliding in a pulley track (32), all connected by way of cable (34), with one end of the cable (34) itself attached to a pivotal holding bracket (36) and its opposite end attached to an adjustment member (38) designed to increase or decrease the length of available cable when turned. The pivotal holding brackets (36) are connected between the lid (12) and the main frame (11). The pivotal holding brackets (36) each include a holding member (37) and a pivoting member (39).

Each holding member (37) is formed having an L-shape and has a respective sliding pulley (30) for each of the cable (34) and pulley apparatus (28) attached at an end section thereof, such that when the lid (12) is pivoted to open or close the interior space, each of the sliding pulley (30) and respective holding member (37) slide along its respective sliding track (32). The pivoting members (39) each being pivotally attached to the opposite end section of each respective holding member (37) and securely attached to the lid (12), such that the pivoting members (39) are adapted to pivot with the lid (12), pivot with respect to each respective holding member (37), and wherein one of the pivoting member (39) contacts the switch (20) when the lid (12) is in a fully opened position such that the electric current is allowed to flow to the side lights (18) and the outlet (22), and disengage from the switch (20) when the lid (12) is retracted from its fully opened position such that the electric current is cut off from the side lights (18) and the outlet (22).

Invisible hinges (40) connect the lid (12) to the cabinet (10). Optionally, a set of small LEDs are used as night lights (42) on each side of the cabinet. Obviously, there is an electrical cord (44) to make the lights (18), the outlet (22), and the night lights (42) functional.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A beauty station formed as a cabinet adapted to be hung on a wall, said cabinet comprising a main structural frame generally shaped as a box having side walls, a top wall, a bottom wall, a back wall, and a front wall defining an interior space; said front wall being formed as a flip down lid member pivotally connected at one edge to said bottom wall to thereby open and close said interior space; a mobile section adapted to move upwards and outwards from said interior space when said lid member is pivoted to open said interior space, and including a mirror, and at least one light source; at least one cable and pulley apparatus connected between said mobile section, said main frame, and said lid member, such that when said lid member is pivoted to open said interior space said mobile section moves upwards and outwards from said interior space, and when said lid member is pivoted to close said interior space said mobile section moves downwards and inwards into said interior space; an electrical system adapted to deliver electricity to said at least one light source; and a switch member connected to said electrical system and said main frame, and adapted to allow electric current to flow to the at least one light source when said lid member is pivoted to open said interior space, and cut off electric current to the at least one light source when said lid member is pivoted to close said interior space.

2. The beauty station of claim 1, wherein said main structural frame includes interior side walls respectively parallel to said side walls and forming interior side portions that are each adapted to house a cable and pulley apparatus, and wherein said side walls each include one sliding track adapted to hold and guide a respective sliding pulley of each said at least one cable and pulley apparatus, such that when said lid member is pivoted each said sliding pulley slides along its respective sliding track.

3. The beauty station of claim 2, wherein a pair of spaced pivotal holding brackets are connected between said lid member and said main frame; said pair of spaced pivotal holding brackets each include a holding member and a pivoting member; each said holding member is formed having an L-shape and has a respective said sliding pulley of each said cable and pulley apparatus attached at an end section thereof, such that when said lid member is pivoted to open or close said interior space each said sliding pulley and respective holding member slide along its respective sliding track; and said pivoting members each being pivotally attached to the opposite end section of each respective holding member and securely attached to said lid member, such that said pivoting members are adapted to pivot with said lid member, pivot with respect to each respective holding member, and wherein one said pivoting member contacts said switch member when said lid member is in a fully opened position such that said electric current is allowed to flow to the at least one light source, and disengage from said switch member when said lid member is retracted from its fully opened position such that said electric current is cut off from the at least one light source.

4. The beauty station of claim 3, wherein said cable of each said cable and pulley apparatus is attached at one end to a respective adjustment member of said mobile section, placed upon a plurality of respective pulleys of said cable and pulley apparatus, and attached at their respective opposite ends to respective distal ends of said end portions of said spaced pivotal holding brackets.

5. The beauty station of claim 4, wherein each said adjustment member of said mobile section includes a screw member that is adapted to increase or decrease the length of available cable when turned.

6. The beauty station of claim 2, wherein said interior side portions of said main structural frame further include a retaining part on each side of said mobile section so as to facilitate the vertical linear movement within a guiding track located on said main frame so as to hold both said main frame and said mobile section in place whether said cabinet is fully opened or closed; and wherein said interior side portions include enough space to house side portions of said moving section when in a closed position.

7. The beauty station of claim 1, wherein said at least one light source comprises a plurality of light bulbs connected on each side of said mobile section, and wherein said plurality of light bulbs connected on each side of said mobile section are adapted to be stored within said interior side portions of said main structural frame when said lid member is pivoted to close said interior space.

8. The beauty station of claim 1, wherein said interior space further includes a plurality of shelves and compartments, such that when said mobile section is moved upwards and outwards from said interior space, said shelves and compartments are exposed and usable.

9. The beauty station of claim 1, wherein said main frame includes at least one night light connected to said electrical system and adapted to be turned on when said beauty station is hung on a wall and is not being used.

10. The beauty station of claim 9, further comprising an additional wire and outlet connected to said electrical system and adapted to offer an electrical connection for additional electrical items.

* * * * *